United States Patent [19]

Stone, Jr.

[11] 4,419,927

[45] Dec. 13, 1983

[54] DECANTER FOR REDUCING OXIDATION AND EVAPORATION OF COFFEE

[75] Inventor: Wayne B. Stone, Jr., Bethesda, Md.

[73] Assignee: Wood Manufacturing Co., Inc., North Flippin, Ark.

[21] Appl. No.: 233,505

[22] Filed: Feb. 11, 1981

[51] Int. Cl.[3] ..... A23F 1/08

[52] U.S. Cl. ..... 99/275

[58] Field of Search ..... 99/275, 279, 306; 222/572, 527, 465, 465 A; 215/309, 344; 220/256, 367, 373, 374; 315/310, 307; 49/292; 34/15, 242

[56] References Cited

U.S. PATENT DOCUMENTS

| | | | |
|---|---|---|---|
| 136,703 | 3/1873 | Childs | 99/306 |
| 242,953 | 6/1881 | McAnespey | 222/500 X |
| 399,741 | 3/1889 | Clarke | 222/572 X |
| 1,108,288 | 8/1914 | Watson | 99/306 X |
| 1,434,740 | 11/1922 | Gibson | 222/465 R |
| 1,554,612 | 9/1925 | Wilson et al. | 99/279 |
| 2,604,233 | 7/1952 | Murphrey | 222/465 R X |
| 3,974,758 | 8/1976 | Stone, Jr. | 99/275 |

FOREIGN PATENT DOCUMENTS

| | | | |
|---|---|---|---|
| 543598 | 1/1955 | Belgium | 220/44 R |
| 661526 | 5/1938 | Fed. Rep. of Germany | 220/44 R |
| 111635 | of 0000 | Fed. Rep. of Germany | 222/386 |
| 26645 | of 1905 | United Kingdom | 99/306 |
| 276192 | 8/1927 | United Kingdom | 222/386.5 |

*Primary Examiner*—Harvey C. Hornsby
*Assistant Examiner*—Christine A. Peterson
*Attorney, Agent, or Firm*—Beveridge, DeGrandi & Kline

[57] ABSTRACT

The pot life of a quantity of decanter contained coffee is significantly increased by maintaining a substantial temperature differential between the surface of the contained coffee and the bottom contents thereof; and dispensing coffee from the bottom of the decanter.

The reduced surface temperature, as contrasted with the higher "drinking temperature" maintained at the bottom of the decanter from which coffee is dispensed, results in a significant decrease in oxidation and a dramatic decrease in evaporation as will be apparent from the exponential nature of the vapor pressure curve for water across the temperature range in question.

This pot life extension may, if desired, be further increased by maintaining superatmospheric pressure within the decanter.

9 Claims, 5 Drawing Figures

DECANTER FOR REDUCING OXIDATION AND EVAPORATION OF COFFEE

BACKGROUND OF THE INVENTION

The deterioration of coffee, i.e. the loss of a "fresh" or palatable flavor and aroma, is primarily caused by oxidation and evaporation. In a conventional 8–12 cup coffee decanter, deterioration is generally so complete within one or two hours, depending on the rate of consumption, as to render the remaining coffee undrinkable.

The role of oxidation, alone, in deteriorating coffee flavor is obvious to anyone who drinks coffee from a Thermos. When the Thermos is first opened, whether after one or several hours, the coffee tastes perfectly fresh. If the Thermos is resealed with a small amount of coffee remaining therein, such as a half cup, it rapidly deteriorates as evidenced by the poor taste when it is consumed, say, one hour later. There was obviously no significant evaporation from the sealed Thermos but fresh air was admitted at the time the first cup was poured.

The deteriorating role of evaporation is even more obvious as the coffee solution is concentrated by evaporation.

The concept of extending the "pot life" of coffee, i.e. that time period during which it retains the flavor and aroma of freshly brewed coffee, by substantially eliminating its exposure to atmosphere while yet retaining the ability to pour coffee in conventional fashion was introduced by applicant's prior U.S. Pat. No. 3,974,758. In a pour type coffee decanter, the patented concept involves sealing the main body of contained coffee with respect to atmosphere. The top of the decanter is sealed by a movable follower, such as a bellows or bag, and that coffee contained within the lower end of a small diameter pour spout opening into the coffee decanter adjacent the bottom thereof serves as a liquid seal between atmosphere and the main body of the decanter contained coffee.

The result is that the only oxidation that can occur takes place at the upper coffee level in the pour spout. By keeping the cross section of the pour spout sufficiently small, that quantity of coffee that is oxidized and subsequently finds its way through the liquid seal to the main reservoir of contained coffee is negligible over the first 4–8 hours depending upon the cross section of the pour spout. Similarly, the only loss to atmosphere that can occur by way of evaporation is at the small upper coffee level in the pour spout since a state of equilibrium inherently exists across a gas/vaporizable liquid interface in a sealed container.

Stated differently, the patented concept involves pouring from the bottom of the decanter while keeping the top of the decanter sealed with a movable follower maintaining atmosphere pressure on the coffee so that it can be poured without creating a vacuum lock.

In applicant'copending application, Ser. No. 219,461, filed Dec. 23, 1980, is disclosed method and apparatus whereby the movable follower may be eliminated and coffee readily dispensed while yet retaining substantially all the advantages of a totally sealed decanter, albeit over a shorter time span, by providing vent means of such small dimension that the vapor pressure of a quantity of contained coffee within the decanter exceeds atmosphere pressure. The result, as explained in the aforesaid copending application, is a vapor seal across the vent means that precludes the ingress of air at all times except when coffee is actually being dispensed through the pour spout. The volume of entry air that occurs during pouring is, of course, negligible as compared with that volume which enters a conventional open decanter over a period of from one to several hours.

A concomitant, and significant, consequence of the restricted vent means is greatly reduced evaporation as compared with a conventional decanter from which the vapor may freely escape.

Thus, where vapor may freely escape, as from a conventional decanter, equilibrium across the gas/liquid interface is never attained and evaporation may proceed to completion. Conversely, in a closed system, partial pressures of the coffee vapor will increase until a state of equilibrium exists at which time for every molecule escaping across the liquid/gas interface in gaseous form another is returning from the gaseous to the liquid form at which point no further liquid volume loss to evaporation occurs. The latter is what occurs in the patented process where the space above the decanter contained coffee is totally sealed.

An analogous result is achieved by the restricted vent means disclosed and claimed in the aforesaid copending application which, in effect, imposes a back pressure on the contained gaseous phase so that equilibrium is approached with the result that percentage return from the gaseous to liquid phase approaches that of escape from liquid to gaseous. The result, over a period of up to about 4–6 hours depending on the rate of depletion by dispensing, is negligible coffee volume loss to evaporation. In actual tests conducted with a six cup volume in a twelve cup decanter with the coffee maintained at 175° F. and a single 1/16″ diameter vent hole; loss to evaporation was less than one-third cup over a five hour period as contrasted with a two and one-half cup loss to evaporation from a conventional decanter. It will be obvious that the smaller the vent means the closer the approach to equilibrium and the lesser volume loss to evaporation.

In summary, concerning the vent means which for the present explanation will be assumed as a single pin hole in an otherwise sealed top of a coffee decanter which decanter includes a small diameter pour spout opening into the decanter immediately adjacent the bottom thereof; the vent means is necessary to permit the pouring of the coffee, in the absence of any movable parts, without developing a vapor lock. Regarding its role in reducing oxidation, the vent means must be of sufficiently small cumulative area to produce a back, or superatmospheric, pressure within the decanter to prevent ingress of air by a vapor seal across the vent means when the decanter is in the upright, or non-pouring, position. The role of the restricted vent means in reducing volume loss through evaporation is that of causing the partial pressures across the gas/liquid interface to approach equilibrium.

Since the overall purpose of the invention disclosed in the aforesaid copending application is to insure that the entire contents of a coffee decanter may be consumed without having to discard the last few cups because they have deteriorated to an unpalatable state; the importance of having a small diameter pour spout extend to substantially the bottom of the decanter and remain submerged at all times as the coffee level is depleted may be appreciated. Thus, by the time the coffee level has been substantially depleted, as for example to the two or three cup line, both oxidation and evaporation will, if permitted, play a far greater deteriorating role than when a full decanter of coffee is initially made. First, the smaller coffee volume will normally be at a higher temperature than the original filled decanter (assuming a standard, automatic drip coffee maker burner to be used) and as with most other chemical reactions, oxidation is accelerated by increased temperature as is the rate of evaporation. Secondly, deterioration due to oxidation proceeds more rapidly because of the proportionally greater surface area exposure in a small volume while even an equal rate of evaporation produces a far greater proportional concentration in a small, as compared with a large, volume of liquid. If the lower end of the pour spout does not remain submerged as the coffee level is depleted the liquid seal is broken, air reaches the remaining coffee to oxidize the same and the approach to equilibrium across the liquid/gas interface is destroyed allowing evaporation to proceed toward completion. This is why many conventional coffee pots of the electric or stove top percolator type which have outside pour spouts are not suitable for use with the present invention. In all cases they have at least a portion of the pour spout opening into the pot at a level well above the bottom of the pot and as soon as this upper level of the pour spout opening into the pot is reached by the declining coffee level the remainder of the coffee is quickly deteriorated by oxidation and evaporation.

Accordingly, the entirety of the lower open end of the pour spout must be positioned so that it remains completely submerged at all times, with the liquid seal intact, until substantially all the coffee is dispensed, else the primary advantage of retaining the palatability of the remaining coffee is lost. In actual practice, with various 8–12 cup coffee decanters it is more desirable to insure that the liquid seal remains intact, if possible, until the next to last cup is dispensed leaving only one cup subject to the deteriorating effects of oxidation and evaporation. In actual practice it is found that this last cup is usually consumed before it is substantially deteriorated. The foregoing translates into a necessary positionment of the lower open end of the pour spout at such a height above the bottom of the decanter that the entire lower open end of the pour spout remains completely submerged at remaining coffee levels falling generally within the range of 1/6 to ¼ the height of a full decanter fill level of an 8–12 cup decanter. The range is stated thusly to take into account various pot capacities and configurations though it will be apparent that the lower end of the spout should be as low as feasible.

If the top assembly is to be placed on the decanter after it is filled with coffee then the vent means need involve only a single vent, or pin hole, opening whereas if the top is to be placed on the decanter prior to its placement under a drip coffee maker to receive freshly brewed coffee through a central "vent means", then a second vent opening must be provided to allow escape of displaced air as the pot is filled. It is not the number or the spacing of the vent openings that is critical, rather it is their cumulative area; i.e. their cumulative area must be sufficiently small as to maintain superatmospheric pressure within the decanter when it contains a quantity of hot coffee above, for example, 160° F. Indeed, specific holes need not be formed in the top assembly if the top assembly is so interfitted with the open top of the decanter that vent air can be admitted while precluding the outflow of coffee as the decanter is tilted to "pour from the bottom". Exemplary of the latter would be a screw cap substantially, but not totally, sealed with respect to atmosphere.

As would be expected from the foregoing discussion, the patented concept wherein the decanter is totally sealed by a movable follower extends the "pot life" of coffee over a longer time span than does the "restricted vent means" concept disclosed in the aforesaid copending application. The reasons are:

(1) There is no air indrawn to the sealed container during dispensing to oxidize the decanter contained reservoir; and (2) The partial pressures across the gas/liquid interface within the decanter reach equilibrium so that there is no evaporative loss to atmosphere whereas the "restricted vent means" concept limits, rather than eliminates, the deteriorating effects of oxidation and evaporation.

SUMMARY OF THE INVENTION

The purposes of the invention are twofold:

(1) To introduce a "temperature differential" concept for extending the pot life of coffee which requires no special top assembly as for sealing or providing a restricted vent means; indeed, the decanter top may include the large central opening characteristic of conventional automatic drip coffee maker decanters; and (2) To combine the "temperature differential" concept with the "vent means" concept to produce, in a decanter having no moving parts, a pot life extension substantially equal to that of the patented concept employing a totally sealed decanter.

The purposes are stated separately because in high usage situations where, for example, a full decanter of coffee is typically consumed within one or two hours, the "temperature differential" concept herein introduced will be quite adequate to keep the coffee fresh whereas, over longer consumption periods, the combination of these concepts will extend the pot life for up to six or eight hours approaching that of the sealed decanter.

The common denominator and a critical feature of both concepts is that of dispensing coffee from immediately adjacent the bottom of the decanter. For most decanter configurations employing an outside pour spout as herein disclosed, the entire pour spout opening to the decanter should fall within the bottom sixth of the decanter fill level since such positioning will normally insure that the lower pour spout opening will be fully submerged with two cups of coffee remaining in the decanter.

The primary coffee deteriorants, oxidation and evaporation, can only take place at the surface of the coffee. The rate of both oxidation and evaporation are a direct function of temperature. Accordingly, pot life extension based on the "temperature differential" concept involves maintaining a coffee surface level temperature which is less than the drinking temperature maintained at the bottom of the decanter from which the coffee is dispensed.

The temperature differential is maintained, in a bottom heated decanter, by forming at least the upper portion of the decanter wall containment and pour spout from a material exhibiting relatively poor thermal conductivity such as a thick walled ceramic (glass or porcelain) or plastic.

Although convective flow within a bottom heated, contained liquid volume would normally tend to maintain an equal temperature throughout the liquid volume, this tendency can be ameliorated to produce a significant temperature differential between the top and bottom of the contained liquid by constructing the containing decanter of a material having low thermal conductivity. This for the reason that the upper portion of the decanter wall will be primarily heated by conduction from the contained liquid whose maximum temperature will typically fall within the range of 160° F.–175° F. as opposed to also being significantly heated by conduction through the decanter wall from the 375° F. heat source on which the decanter sits as is the case with a metal decanter and, to a slightly lesser extent, with a short, thin walled, blow molded borosilicate decanter. The result is that in the case of a coffee decanter constructed from a material of relatively low thermal conductivity, such as porcelain or thick walled glass for example, the upper decanter wall portion is cooler than is the lower wall portion and decanter bottom sitting directly on the burner. This translates into a 5° F.–15° F. temperature differential between the upper coffee level within the decanter and the bottom of the coffee volume from which the coffee is poured.

The reduced surface temperature, as contrasted with the higher "drinking temperature" maintained at the bottom of the decanter from which coffee is dispensed, results in a significant decrease in both oxidation and evaporation as will be apparent from the exponential nature of the vapor pressure curve for water across the temperature range in question.

The desired temperature for decanter contained coffee is generally considered to be 175° F. Coffee maintained at this temperature exhibits a vapor pressure of approximately 335 mm Hg as contrasted with a vapor pressure of approximately 230 mm Hg at 160° F. Since evaporation can only take place from the liquid surface is will be apparent that the coffee to be consumed, which is poured from the bottom of the decanter, may be kept at a desired drinking temperature of 175° F. while the upper surface level thereof is at a substantially lower temperature exerting a far less vapor pressure resulting in a dramatic decrease in evaporative loss to atmosphere. In the specific example just given, the vapor pressure in a conventional decanter containing coffee at 175° F. would be over 50% greater than the vapor pressure of coffee maintained in accordance with the "temperature differential" concept where the differential is 15° F. between the top and bottom of the decanter.

Since oxidation, too, can only take place at the liquid surface and since, as with most chemical reactions, the rate of oxidation is a direct function of temperature it will be clear that oxidation is similarly reduced.

The precise magnitude of the temperature differential can be controlled, inter alia, by the height and wall thickness of the decanter.

The specific decanter herein illustrated is of porcelain construction having, for the most part, a wall thickness of $\frac{1}{4}''$ which is locally thickened adjacent the pour spout, at the handle attachment and at the base which rests on the warming burner. Test data was compiled using a similarly configured porcelain decanter having a 60 oz. capacity, a maximum base diameter of 5" and a fill level height of 7 oz. The decanter was initially filled with coffee from an automatic drive coffee maker delivering coffee at 175° F. The burner control was set to provide a maximum burner surface temperature of 375° F. and to maintain the temperature of the coffee immediately adjacent the bottom of the decanter at 175° F. The temperature at the upper coffee level within the decanter subsequently stabilized at 165° F. and the upper coffee level within the small exterior pour spout at 160° F. The latter is readily explainable on the basis of necessarily reduced convective flow within the relatively long, small diameter pour spout construction which is further removed from conductive heating both by the decanter contained coffee and the burner. In the test decanter, a pour spout having a circular cross-section measuring $\frac{3}{8}''$ in diameter was employed. The additional significance of the greatly reduced temperature at the coffee surface in the pour spout will be later described in conjunction with the second stated object of the invention; the combination of the "temperature differential" and "vent means" concepts.

The significance of the 10° F. differential between the top and bottom of the contained coffee is obvious from the nature of the vapor pressure curve across this temperature range as already described.

When employing a top assembly of more or less conventional design and having a large central opening from which vapor may freely escape, the pot life of coffee maintained in accordance with the example just given is approximately doubled depending upon the rate of depletion by consumption.

A dramatic increase in pot life is achieved when the "restricted vent means" concept is combined with the "temperature differential" concept just described. In that instance, evaporative loss to atmosphere and oxidation occuring from and at the large coffee surface level within the decanter are sharply limited by the aforedescribed approach to equilibrium and vapor seal, respectively. Both of these deteriorants are even further limited by the lower surface temperatures within the decanter when the same is constructed of a poor thermal conductor.

The most significant aspect, however, of the combination of these two concepts relates to the upper coffee level within the pour spout. When employing the "restricted vent means" concept, the main reservoir of contained coffee is protected against oxidation and evaporation with only the small diameter pour spout presenting a coffee surface where oxidation and evaporation are unimpaired. The fact that this surface area exposure is quite small so that the deteriorating effects are so limited as to be considered negligible over a time span of several hours is the basis for the success of the "restricted vent means" concept. Nevertheless, deterioration does occur at this surface albeit to a negligible extent as compared with a conventional, fully vented decanter. Now, even that limited deterioration taking place within the pour spout may be sharply reduced in accordance with the "temperature differential" concept herein described. Thus, with reference to the vapor pressure curve, it will be seen that the temperature differential (15° F. in the test case described) between the upper pour spout coffee level and the bottom of the decanter from which the coffee is dispensed will produce a significant increase in pot life even beyond that achieved by the "restricted vent means" concept, alone.

Because of the small size of the pour spout, the temperature differential just described (175° F. at the bottom of the decanter and 160° F. at the upper coffee level within the pour spout) does not result in a significant decreased in delivered coffee temperature. In test situations, pouring into a cup at room temperature, delivered cup temperatures measured, consistently, at 164° F.±1° F. as opposed to the generally accepted cup temperature of 165° F.

As would be suspected from the foregoing, there is no significant temperature differential between the upper and lower portions of a quantity of coffee contained in a conventional, thin walled, borosilicate decanter such as disclosed in the aforesaid copending application and this also holds true for the upper coffee level within the internal pour spout. The latter is explainable on the basis that the small diameter pour spout and its small volume of contained liquid quickly reaches temperature equilibrium with the totally surrounding liquid as contrasted with the external pour spout herein disclosed which is relatively isolated from conductive heating by the contained liquid.

DESCRIPTION OF THE PREFERRED EMBODIMENTS

Figure 1:
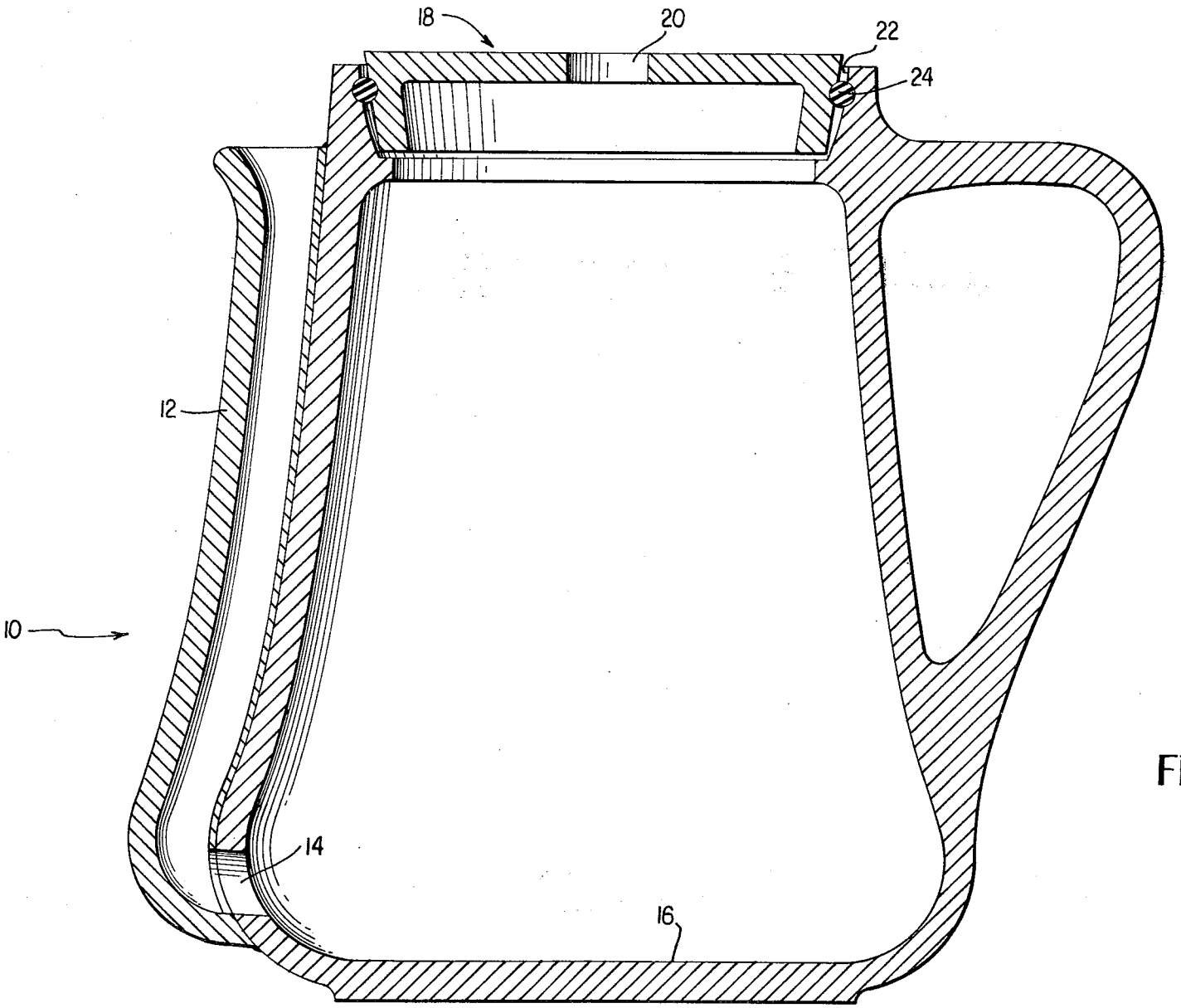
FIG. 1 is a vertical section of a coffee decanter adapted to maintain a temperature differential between the surface of a quantity of contained coffee and the bottom contents thereof.
Figure 2:
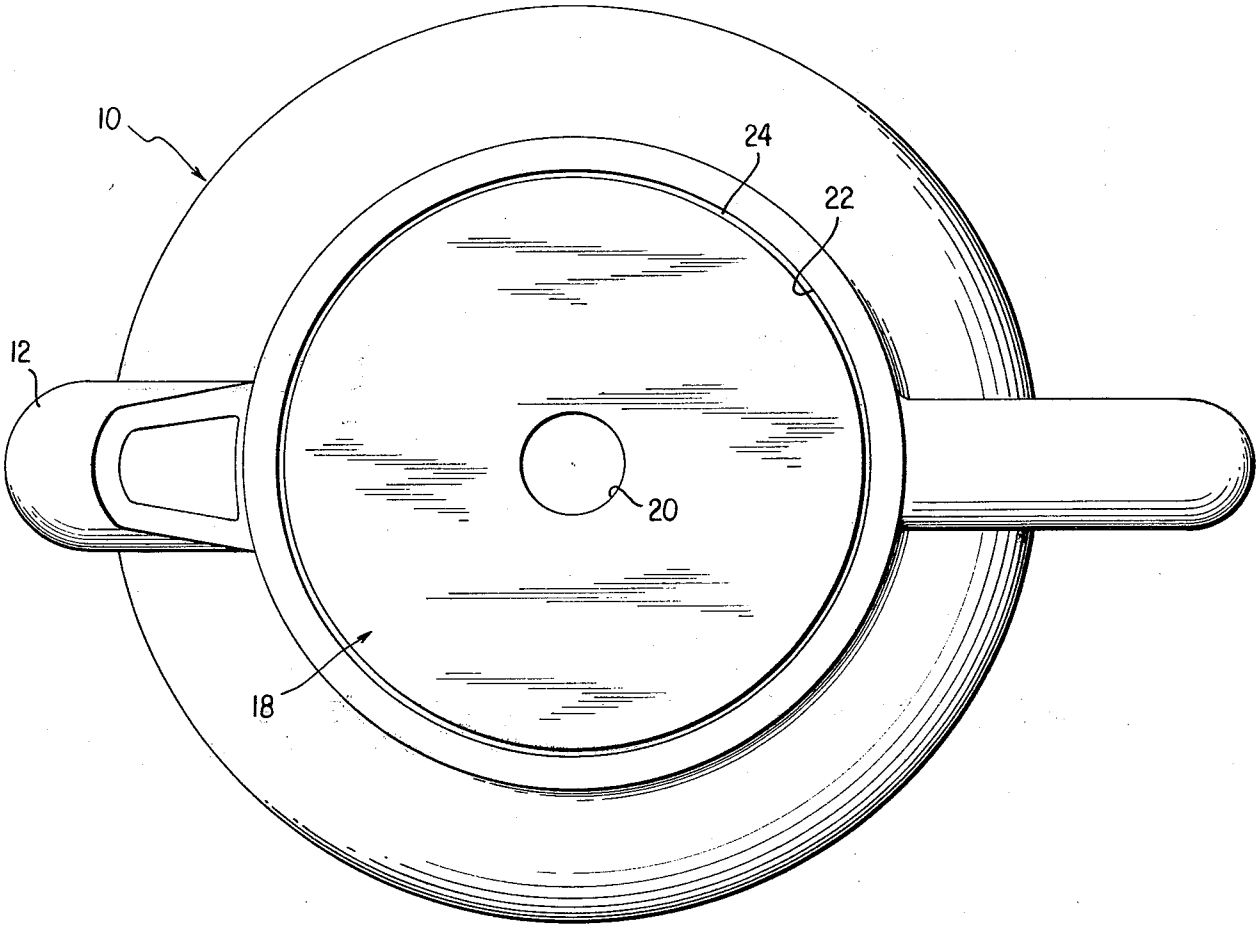
FIG. 2 is a top plan view of FIG. 1.

In FIGS. 1 and 2 is illustrated a coffee decanter 10 having an outside pour spout 12 communicating with the interior of the decanter via opening 14 immediately adjacent a thickened bottom wall 16 adapted to seat on a warming burner, not shown. The decanter and pour spout are of relatively thick walled, porcelain construction and the lower spout opening 14 is wholly contained within the bottom sixth of the decanter fill level. A top assembly 18 having a large central opening 20 is peripherally sealed with respect to the upper end 22 of the decanter 10 by a deformable seal 24.

Figure 5:
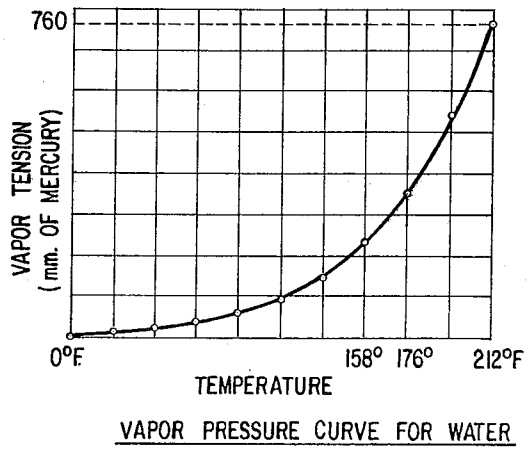
FIG. 5 is a graph of the vapor pressure curve for water.

In use, freshly brewed coffee is introduced to the decanter such as by flow from an automatic drop coffee maker through central opening 20 in top assembly 18. With decanter bottom wall 16 resting on a conventional, thermostatically controlled warming burner whose maximum surface temperature will vary from 350° F.–425° F., as among the various manufacturers, the temperature of that coffee immediately adjacent the bottom wall will typically stabilize at a "drinking temperature" within the range of 160° F.–180° F. Because of the poor thermal conductivity of the porcelain construction, the surface temperature of the decanter contained coffee will be less than the drinking temperature at the bottom of the decanter by from 5° F.–15° F. depending, inter alia, on burner temperature, volume of contained coffee, height and wall thickness of the decanter. In any event, a temperature differential inherently exists in such a bottom heated decanter and the differential is even greater at the coffee surface level in the pour spout. By reference to the vapor pressure curve for water shown in FIG. 5 it will be seen that the exponential nature of the curve across the range in question converts even a small temperature differential to a large change in vapor pressure. Because of the fact that coffee is dispensed from the bottom of the decanter where drinking temperature is maintained, the lower surface level temperature has no drawbacks from the standpoint of hot coffee service but has the advantage of greatly reduced evaporative loss due to the lower vapor pressure. The lower surface temperature also results in a lesser rate of oxidation.

It is to be understood that the decanter 10 of FIGS. 1 and 2 is fully vented to atmosphere via the large central opening 20 so that both oxidation and evaporation may freely take place at and from the upper surface of the decanter contained coffee. It is the reduced rate of both these deteriorants as a function of the lower surface level temperature as compared with the higher drinking temperature necessarily maintained at the bottom of the decanter that is relied upon to extend the pot life. The peripheral seal 24 between the top assembly and the decanter is to insure against leakage over the top wall of the decanter when coffee is being dispensed through pour spout 12.

Figure 3:
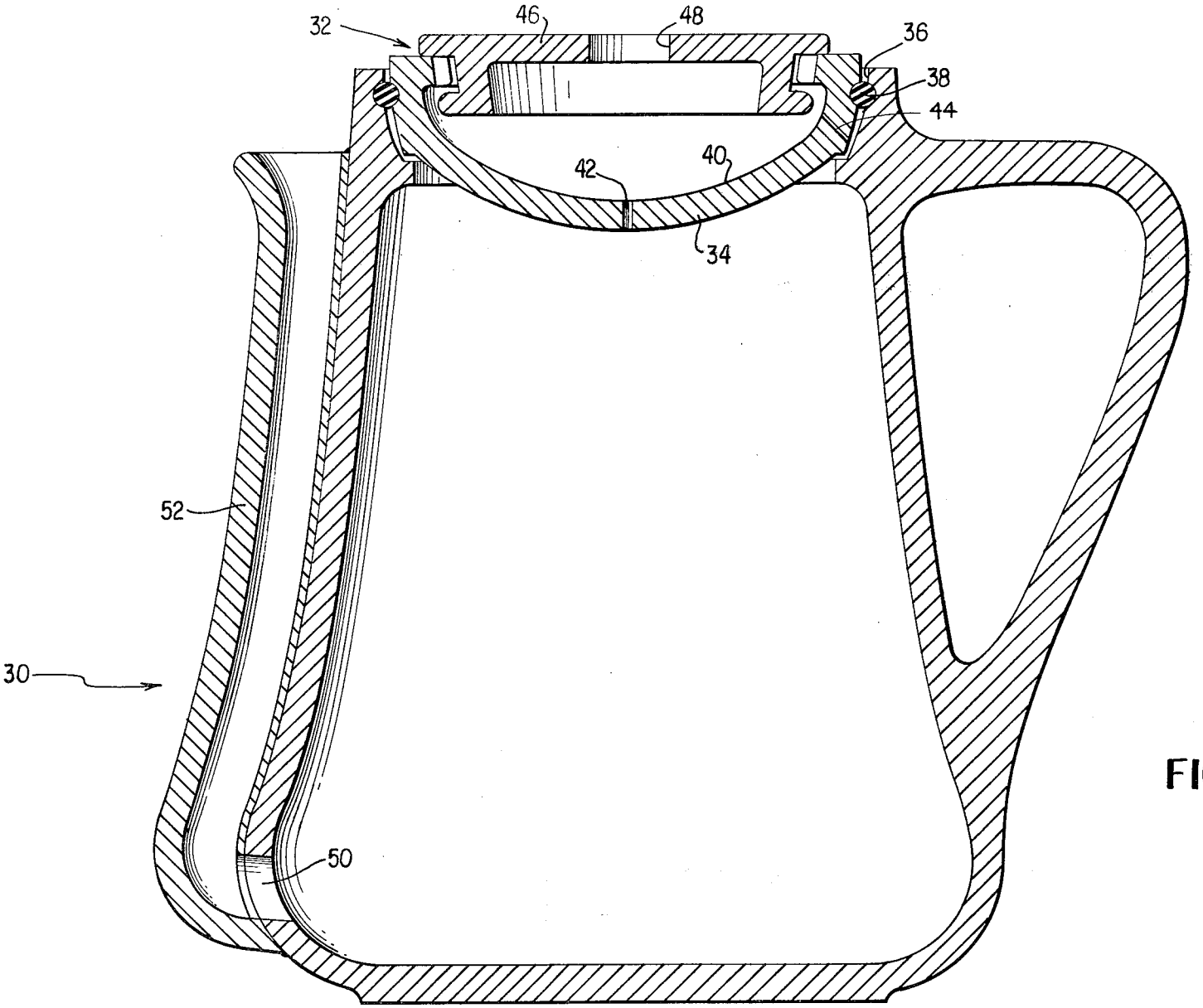
FIG. 3 is a vertical section of the decanter of FIG. 1 fitted with an alternate top assembly for maintaining superatmospheric pressure on the contained coffee.
Figure 4:
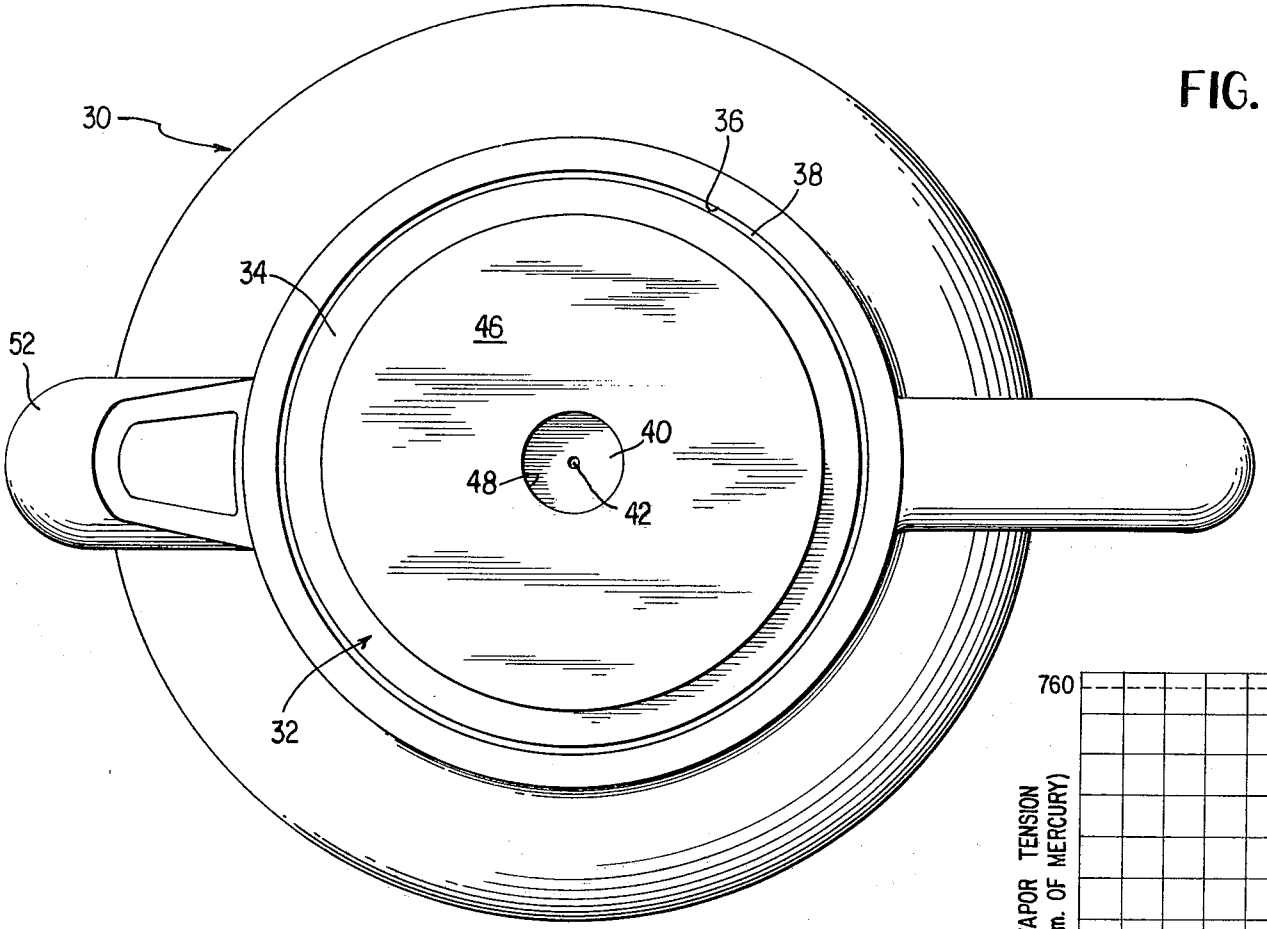
FIG. 4 is a top plan view of FIG. 3.

The decanter 30 of FIGS. 3 and 4 differs from the decanter 10 of FIG. 1 only in the construction of the top assembly 32. Top assembly 32 includes a top member 34 which is peripherally sealed with respect to decanter top wall 36 by a seal ring 38. Top member 34 is downwardly dished to form a well portion 40 and is imperforate except for a small central vent 42 as on the order of 1/16" and an additional pin hole vent 44. The upper end of top member 34 is covered with a removable, decorative top 46 having a large central opening 48.

In use, coffee is introduced to the well portion 40 through central opening 48 from which the coffee flows into decanter 30 via central vent 42. Pin hole 44 permits displacement of air from decanter 30 as the coffee level rises above the lower pour spout opening 50. With the coffee decanter 30 filled and that coffee immediately adjacent the bottom thereof maintained at drinking temperature even that reduced vapor pressure regulating from the temperature differential concept described above results in a superatmospheric pressure above the contained coffee level because of the restricted nature of vent means 42 and 44. It is to be understood that this effect may be enhanced and pot life further extended by providing only a single pin hole rather than the central vent 42 in which event top assembly 32 would be interfitted with the decanter after it is filled with coffee. In either event, the body of contained coffee is sealed with respect to atmosphere when in the upright, non-pouring position by a liquid seal within pour spout 52 and a vapor seal across the restricted vent means. Thus, oxidation is sharply limited. Similarly, partial pressures across the liquid/gas interface approach equilibrium sharply limiting evaporative loss.

The explanation, to this point, of limiting oxidation and evaporation by the limited vent means concept is the same as is contained in the aforesaid copending application and reference may be had thereto for further descriptive material.

Although the combination of the "temperature differential" and "restricted vent means" concepts results in pot life extension significantly greater than either, alone; it is thought that the most important aspect as it relates to the combination of these concepts is the fact of the outside pour spout being relatively isolated, thermally, from the heating sources (contained coffee and burner). The explanation is thought to be as follows: Since the upper coffee level within the pour spout is the only area, albeit quite small, at which oxidation and evaporation are unimpeded it will be apparent that, in the combination, if the temperature at the upper pour spout level is significantly less than that necessarily maintained drinking temperature, both oxidation and evaporation from this area will be reduced. Since the temperature reduction is even greater than at the decanter contained surface level because of its relatively remove location, and since the temperature range involved lies on an exponential portion of the vapor pressure curve, the importance of combining these concepts can be seen. Thus, in the aforesaid copending application, the temperature at the upper coffee level in the pour spout is substantially the same as the decanter contained coffee by which it is surrounded which coffee is, in turn, at substantially the same temperature as that at the bottom of the decanter since the same is of thin walled borosilicate construction so that the pot life of the same is less than in the present construction employing the temperature differential concept.

Although the temperature differential that can be achieved is somewhat less, the temperature differential concept can be practiced using a decanter of composite construction if at least the upper wall portion of the decanter is constructed of a material of low thermal conductivity. Exemplary is a composite decanter having a stainless steel bottom joined with an upper plastic wall construction, such as polysulfone for example, and an outside pour spout.

I claim:

1. A coffee decanter including a body portion having a bottom and sides which define a container for receiving coffee, the upper portion of said sides defining a mouth for ingress of coffee to within said container, a pour spout for egress of coffee from said container, and a top assembly removably received by said mouth for providing a cover contiguous to and across said mouth; said pour spout having a lower inlet opening through one side of said body portion to the interior of said container in adjacency to said bottom thereof and with the entire opening thereof below the lower quarter of the fill level thereof, extending to a height so that coffee will not overflow therefrom on filling of said container with coffee, and having a relatively small upper outlet opening; at least the upper portion of said container and said pour spout consisting of a material exhibiting poor thermal conductivity and in which the thermal gradient of such material in relation to the thickness and the height thereof are interrelated to consequentially facilitate a temperature differential in an appreciable volume of coffee within the decanter such that the upper level of coffee therewithin is cooler than the lower level of coffee therewithin and the upper level of coffee in said pour spout is appreciably cooler than both the upper and lower level of coffee within the decanter.

2. A coffee decanter as specified in claim 1 wherein the cover provided by said top assembly comprises a seal for reducing oxidation and evaporation of coffee within said container, said top assembly including vent means, the cumulative areas of said vent means being such that the vapor pressure of heated coffee in the decanter exceeds atmospheric pressure to substantially create a vapor seal across said vent means.

3. A coffee decanter as specified in claim 1 wherein the thermal gradient of such material in relation to the thickness and height thereof are interrelated to consequentially facilitate a temperature differential in an appreciable volume of coffee within the decanter such that the upper level of coffee therewithin is from substantially 5°–15° F. cooler than the lower level of coffee therewithin.

4. A coffee decanter as specified in either of claims 1, 2, or 3 wherein the same is substantially entirely of material having said thermal gradient properties.

5. A coffee decanter as specified in claim 4 and wherein the entire opening of said lower inlet of said pour spout opens to within said coffee decanter below the lower sixth of the full level thereof.

6. A coffee decanter as specified in either of claims 1, 2, or 3 wherein said pour spout is substantially continuous along an external side thereof.

7. A coffee decanter as specified in claim 6 and wherein the same is substantially entirely of material having said gradient properties.

8. A coffee decanter as specified in claim 4 and wherein the sides of said body portion of said coffee decanter and the walls of said pour spout are of substantially the same thickness.

9. A coffee decanter as specified in claim 7 and wherein the sides of said body portion of said coffee decanter and the walls of said pour spout are of substantially the same thickness.

* * * * *

UNITED STATES PATENT AND TRADEMARK OFFICE

CERTIFICATE OF CORRECTION

PATENT NO. : 4,419,927

DATED : December 13, 1983

INVENTOR(S) : Wayne B. Stone, Jr.

It is certified that error appears in the above-identified patent and that said Letters Patent is hereby corrected as shown below:

Claim 1, should appear as shown below:

1. A coffee decanter including a body portion having a bottom and sides which define a container for receiving coffee, the upper portion of said sides defining a mouth for ingress of coffee to within said container, a pour spout for egress of coffee from said container, and a top assembly removably received by said mouth for providing a cover contiguous to and across said mouth; said pour spout having a lower inlet opening through one side of said body portion to the interior of said container in adjacency to said bottom thereof and with the entire opening thereof below the lower quarter of the fill level thereof, extending to a height so that coffee will not overflow therefrom on filling of said container with coffee, and having a relatively small upper outlet opening; at least the upper portion of said container and said pour spout consisting of a material exhibiting poor thermal conductivity and in which the thermal gradient of such material in relation to the thickness and the height thereof are interrelated to consequentially facilitate a temperature differential in an appreciable volume of coffee within the decanter such that the upper level of cofeee therewithin is cooler than the lower level of coffee therewithin and the upper level of coffee in said pour spout is appreciably cooler than both the upper and lower level of coffee within the decanter; the cover provided by said top assembly comprises a seal for reducing oxidation and evaporation of coffee within said container, said top assembly including vent means, the cumulative areas of said vent means being such that the vapor pressure of heated coffee in the decanter exceeds atmospheric pressure to substantially create a vapor seal across said vent means.

UNITED STATES PATENT AND TRADEMARK OFFICE

CERTIFICATE OF CORRECTION

PATENT NO. : 4,419,927

DATED : December 13, 1983

INVENTOR(S) : Wayne B. Stone, Jr.

It is certified that error appears in the above-identified patent and that said Letters Patent is hereby corrected as shown below:

Column 10, delete Claim 2.

On the title page, "9 Claims" should read -- 8 Claims --.

Signed and Sealed this

*Fourteenth* Day of *February 1984*

[SEAL]

*Attest:*

GERALD J. MOSSINGHOFF

*Attesting Officer*

*Commissioner of Patents and Trademarks*